US008872074B2

(12) United States Patent
Recio et al.

(10) Patent No.: US 8,872,074 B2
(45) Date of Patent: Oct. 28, 2014

(54) CENTRIFUGAL SWITCH BYPASS FOR REVERSE TUMBLE DRYERS

(75) Inventors: Steven M. Recio, Louisville, KY (US); Erick Graven, Louisville, KY (US); Ashley Burt, Louisville, KY (US); Joseph Frazar, Louisville, KY (US)

(73) Assignee: General Electric Company, Schenectady, NY (US)

( * ) Notice: Subject to any disclaimer, the term of this patent is extended or adjusted under 35 U.S.C. 154(b) by 587 days.

(21) Appl. No.: 11/853,271

(22) Filed: Sep. 11, 2007

(65) Prior Publication Data

US 2009/0064532 A1 Mar. 12, 2009

(51) Int. Cl.
*D06F 58/28* (2006.01)

(52) U.S. Cl.
CPC ..... *D06F 58/28* (2013.01); *D06F 2058/2854* (2013.01); *D06F 2058/289* (2013.01)
USPC ..... 219/494; 34/321

(58) Field of Classification Search
USPC ..... 219/494; 34/22, 260, 261, 312, 318, 34/327, 543, 553, 562, 108, 524, 526
See application file for complete search history.

(56) References Cited

U.S. PATENT DOCUMENTS

| | | | | |
|---|---|---|---|---|
| 2,643,463 | A | 6/1953 | Grantham | |
| 2,961,776 | A | 11/1960 | Hughes | |
| 3,020,648 | A | 2/1962 | Strike | |
| 3,309,783 | A * | 3/1967 | Worst | 34/553 |
| 3,316,659 | A | 5/1967 | Lauck | |
| 3,328,897 | A | 7/1967 | Purkett | |
| 3,507,052 | A | 4/1970 | Robandt | |
| 3,509,640 | A | 5/1970 | Bullock et al. | |
| 3,514,867 | A | 6/1970 | Patrick | |
| 3,824,476 | A | 7/1974 | Cotton | |
| 3,890,720 | A | 6/1975 | Nichols | |
| 4,109,397 | A | 8/1978 | Daily | |
| 4,127,015 | A | 11/1978 | Platt et al. | |
| 4,483,082 | A | 11/1984 | Ellingson | |
| 4,488,363 | A | 12/1984 | Jackson et al. | |
| 4,586,267 | A * | 5/1986 | Sussman | 34/490 |
| 4,663,861 | A | 5/1987 | Scriber | |
| 4,713,894 | A | 12/1987 | Roth et al. | |
| 4,908,959 | A | 3/1990 | Kretchman et al. | |
| 5,281,956 | A | 1/1994 | Bashark | |

(Continued)

OTHER PUBLICATIONS

U.S. Official Action mailed Dec. 6, 2011 in U.S. Appl. No. 12/325,219, 9 pgs.

(Continued)

*Primary Examiner* — Brian Jennison
(74) *Attorney, Agent, or Firm* — Merchant & Gould

(57) ABSTRACT

Systems and methods for bypassing a centrifugal switch are disclosed. The systems may include a bypass relay operatively connected to the heating element and configured to bypass the centrifugal switch prior to the drum reversing rotational direction, and allow the heating element to remain energized during the drum reversing rotational direction. The centrifugal switch bypass circuit further includes a relay hold circuit operatively connected to the bypass relay and configured to cause the bypass relay to continue bypassing the centrifugal switch during the drum reversing rotational direction. The method may include, once the drum begins reversing the rotational direction, utilizing a bypass relay to bypassing the centrifugal switch. Finally, the method may include utilizing a relay hold circuit to cause the bypass relay to continue bypassing the centrifugal switch during reversal of the rotational direction.

17 Claims, 4 Drawing Sheets

(56) References Cited

U.S. PATENT DOCUMENTS

| | | | | |
|---|---|---|---|---|
| 5,371,956 | A | 12/1994 | St. Louis | |
| 5,388,348 | A | 2/1995 | Tanaka et al. | |
| 5,555,645 | A * | 9/1996 | Joslin | 34/499 |
| 5,651,194 | A | 7/1997 | Hayashi | |
| 6,026,592 | A | 2/2000 | Herr | |
| 6,334,267 | B1 | 1/2002 | Slutsky | |
| 7,007,409 | B2 | 3/2006 | Moschutz et al. | |
| 7,065,905 | B2 | 6/2006 | Guinibert et al. | |
| 7,194,824 | B2 | 3/2007 | Wang | |
| D577,469 | S | 9/2008 | Reim et al. | |
| 7,552,545 | B2 | 6/2009 | Crawford et al. | |
| 7,591,082 | B2 | 9/2009 | Lee et al. | |
| 8,065,816 | B2 | 11/2011 | Ricklefs et al. | |
| 2003/0101617 | A1 | 6/2003 | Prajescu et al. | |
| 2006/0272177 | A1 | 12/2006 | Pezier et al. | |
| 2008/0022551 | A1 | 1/2008 | Banta et al. | |
| 2008/0088989 | A1 | 4/2008 | Johnson et al. | |
| 2010/0132218 | A1 | 6/2010 | Etemad et al. | |
| 2010/0132219 | A1 | 6/2010 | Etemad et al. | |

OTHER PUBLICATIONS

U.S. Official Action mailed Dec. 12, 2011 in U.S. Appl. No. 12/325,221, 15 pgs.

Chinese Office Action issued in connection with CN Application No. 200810213863.1, Jun. 29, 2011.

U.S. Official Action mailed Jun. 11, 2013 in U.S. Appl. No. 12/325,221, 20 pages.

U.S. Official Action mailed Jul. 8, 2011 in U.S. Appl. No. 12/325,221, 14 pgs.

U.S. Official Action mailed Feb. 20, 2013 in U.S. Appl. No. 12/325,221, 15 pages.

U.S. Official Action mailed Oct. 7, 2011 in U.S. Appl. No. 12/325,219, 12 pages.

U.S. Official Action mailed May 9, 2012 in U.S. Appl. No. 12/325,219, 10 pages.

* cited by examiner

CENTRIFUGAL SWITCH BYPASS FOR REVERSE TUMBLE DRYERS

CROSS-REFERENCE TO RELATED APPLICATIONS

The present application is related to U.S. patent application having Ser. No. 12/325,221 titled "Dryer With Reverse Tumble Action" filed Nov. 30, 2008 and U.S. patent application having Ser. No. 12/325,219titled "Dryer With Stationary Drying Cycle" filed Nov. 30, 2008.

FIELD OF INVENTION

Embodiments of the present invention relate to bypass switches. More specifically, embodiments of the present invention relate to systems and methods for bypassing centrifugal switches found in dryers.

BACKGROUND OF THE INVENTION

Centrifugal switches are a safety feature that prevents the heating element from operating when the drum is not rotating. Currently, dryers use centrifugal switches to ensure that the heating element does not operate when the drying compartment (i.e. drum) is not rotating. Generally, centrifugal switches used in dryers are normally open and as the drum reaches a minimum rotation speed, the switches are "thrown" to the closed position, thereby completing the circuit and allowed the heating element to receive power. Should the drum stop rotating or the rotation speed fall below the minimum rotation speed, the centrifugal switch returns to the normally open position, thereby breaking the circuit and cutting power to the heating element.

There is a long restart time for gas heating elements. In other words, after power has been cut from the heating elements, there is a long delay in returning the heating element to the same heat output as before the power was cut. For reversible dryers the long restart time presents a significant problem for dryers in which the drum shall change directions multiple times throughout a drying cycle. The restart time can add significant time to the drying cycle. For electric dryers the centrifugal switch typically carries higher current and reversible dryers would cause unnecessary activation and deactivation (i.e. "short cycling") of the heating element. This would in return reduce the useful life (i.e. reliability) of the centrifugal switch. Simple removing or totally bypassing the centrifugal switch is not an option because removing or totally bypassing the centrifugal switch would remove an important safety feature that prevents runaway heating element conditions. That is, removing the centrifugal switch may lead to the heating element being energized when the drum is stationary for extended periods of time.

Having the above identified problems in mind, there exists a need for a dryer having a configuration that would allow the heating element to remain energized when the drum slows and reverses rotational direction while still preventing the heating elements from remaining energized while the drum is stationary for extended periods of time.

BRIEF DESCRIPTION OF THE INVENTION

Consistent with embodiments of the present invention, dryer centrifugal switch bypass circuits for a dryer having a reverse tumbling action are disclosed. The dryer comprises a drum, a motor, a centrifugal switch, and a heating element. The centrifugal switch bypass circuit comprises a bypass relay operatively connected to the heating element and configured to bypass the centrifugal switch prior to the drum reversing rotational direction, and allow the heating element to remain energized during rotational direction reversal. The centrifugal switch bypass circuit further includes a relay hold circuit operatively connected to the bypass relay and configured to cause the bypass relay to continue bypassing the centrifugal switch during rotational direction reversal.

Still consistent with embodiments of the present invention, methods for bypassing a centrifugal switch are disclosed. The method may include receiving an indication that a drum is reversing rotational direction. The method may further include, once the drum begins reversing the rotational direction, utilizing a bypass relay to bypass the centrifugal switch. Finally, the method may include utilizing a relay hold circuit to cause the bypass relay to continue bypassing the centrifugal switch during reversal of the rotational direction.

Various aspects of the invention may include a relay hold circuit. The relay hold circuit may comprise an optocoupler configured to output a first signal and a NPN transistor configured to be activated by the first signal. The relay hold circuit may further include a field effect transistor configured to output a second signal to a first side of a bypass relay coil. Finally, the relay hold circuit may include a controller configured to determine when the bypass relay coil should be closed and provide a ground signal to a second side of the bypass relay coil to close the bypass relay coil when the controller determines that the bypass relay coil should be closed.

BRIEF DESCRIPTION OF THE FIGURES

Non-limiting and non-exhaustive embodiments are described with reference to the following figures, wherein like reference numerals refer to like parts throughout the various views unless otherwise specified.

GENERAL DESCRIPTION

Figure 1:
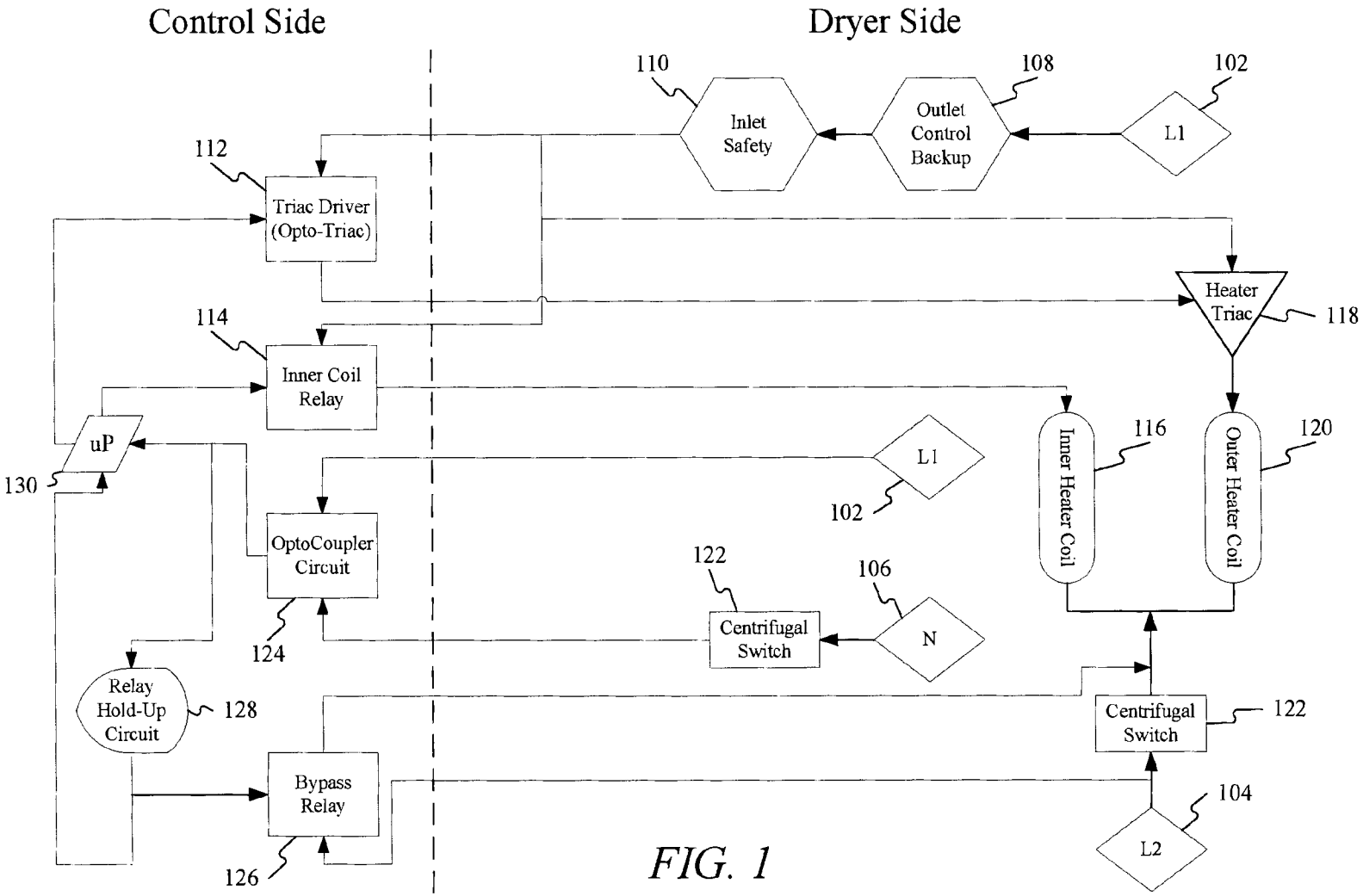
FIG. 1 depicts a control diagram for an electric dryer consistent with embodiments of the invention.

Reference may be made throughout this specification to "one embodiment," "an embodiment," "embodiments," "an aspect," or "aspects" meaning that a particular described feature, structure, or characteristic may be included in at least one embodiment of the present invention. Thus, usage of such phrases may refer to more than just one embodiment or aspect. In addition, the described features, structures, or characteristics may be combined in any suitable manner in one or more embodiments or aspects. Furthermore, reference to a single item may mean a single item or a plurality of items, just as reference to a plurality of items may mean a single item. Moreover, use of the term "and" when incorporated into a list is intended to imply that all the elements of the list, a single item of the list, or any combination of items in the list has been contemplated. Throughout this specification, electricity, power, and current may be used interchangeably.

Throughout this specification the centrifugal switch will be assumed to be a "normally open" switch and a rotating drum will be said to "throw" or "close" the centrifugal switch.

However, it is contemplated that the centrifugal switch may be a "normally closed" switch and a rotating drum may be said to "open" the centrifugal switch. Whether a normally open or normally closed centrifugal switch is implemented, the desired result is that during drum rotation, the centrifugal switch allows the heating element to be activated. In addition, stating a drum is "not rotating" or any equivalent term implies that the drum is either stationary or rotating at a speed too slow to cause a centrifugal switch to be in the closed position.

During a drying cycle the drum may reverse rotational direction multiple times throughout the drying cycle. As a safety measure, centrifugal switches are utilized to deactivate a dryer's heating element when the drum is not rotating. Embodiments of the present invention utilize circuitry, as opposed to a purely software solution, for bypassing a centrifugal switch when reversing the rotational direction of the drum. The circuitry includes components that may create a time constant within the circuit that may limit the amount of time the bypass circuit may be allowed to bypass the centrifugal switch. Furthermore, the circuitry may monitor the rotation of the drum and override the time limit created by the time constant. Most importantly, the circuitry removes the dependence on software for providing the only failsafe to prevent the heating elements from activating when the drum fails to rotate or rotates slower than the required rotation speed.

DETAILED DESCRIPTION

Various embodiments are described more fully below with reference to the accompanying drawings, which form a part hereof, and which show specific embodiments of the invention. However, embodiments may be implemented in many different forms and should not be construed as limited to the embodiments set forth herein; rather, these embodiments are provided so that this disclosure will be thorough and complete, and will fully convey the scope of the invention to those skilled in the art. Accordingly, the following detailed description is, therefore, not to be taken in a limiting sense.

Referring now to the figures, FIG. 1 depicts a control diagram for an electric dryer depicting a control side and a dryer side consistent with embodiments of the invention. Typically an electric dryer operates at 240 VAC with two hot wires (120 VAC each) as indicated by reference numerals 102 and 104 and one neutral wire, as indicated by reference numeral 106, powering the dryer. Upon entering the dryer electricity flows through an outlet safety backup 108 and an inlet safety 110. Outlet safety backup 108 and inlet safety 110 are thermostats used to cut power to the dryer should temperatures within the dryer exceed predetermined limits. After the electricity travels through outlet safety backup 108 and inlet safety 110, it travels to a triac driver 112 and an inner coil relay 114. After exiting inner coil relay 114, electricity may flow to an inner heater coil 116 and after exiting triac driver 112, electricity may flow to a heater triac 118 and to an outer heater coil 120.

In order to achieve the required 240 VAC, electricity from hot wire 104 must travel through a centrifugal switch 122. Centrifugal switch 122 may be a single pole double throw switch. In other aspects of the invention centrifugal switch 122 may be a single pole single throw switch. When the drum is not rotating centrifugal switch 122 is open and inner heating coil 116 and outer heating coil 120 do not receive the required 240 VAC needed for operation. Plus, neutral 106 is open preventing current from flowing between hot wire 102 and ground. Once the drum is rotating, centrifugal switch 122 is "thrown" thereby completing the circuit and allowing the dryer to operate as normal.

Hot wire 102 also provides power to an optocoupler 124. Because optocoupler 124 is also connected to centrifugal switch 122, optocoupler 124 does not receive power until the drum rotates and centrifugal switch 122 is thrown. During operation of the dryer optocoupler 124, a bypass relay 126, microcontroller 130, and a relay hold up circuit 128 operate to keep inner heating coil 116 and outer heating coil 120 activated while the drum reverses its rotational direction. Note that bypass relay 126 may comprise any switching device.

To reverse the rotational direction of the drum, a controller may shut down the dryer motor. Once the drum has stopped, the polarity on the motor is reversed to cause the motor (i.e. the drum) to reverse rotation direction. During drum rotation, optocoupler 124 is used to power relay hold up circuit 128, keeping capacitor 314 discharged. Before the drum begins to slow down in order to change rotational direction, bypass relay 126 bypasses centrifugal switch 122 thereby keeping inner heating coil 116 and outer heating coil 120 activated while the drum reverses its rotational direction.

Once the drum has returned to the desired rotation speed, bypass relay 126 opens and power flows through centrifugal switch 122. If the drum does not reach the desired rotation speed, relay hold up circuit 128 may time out and cause bypass relay 126 to open and prevent or shut down inner heater coil 116 and outer heater coil 120. The interactions of optocoupler 124, bypass relay 126, and relay hold up circuit 128 will be discussed further below with respect to FIG. 3.

Micropede 130 provides a ground path to a relay coil. Micropede 130 also monitors the state of the centrifugal switch (i.e. open or closed and controls drum rotation/direction and the heating elements via supplementary relays, triacs, etc.

Figure 2:
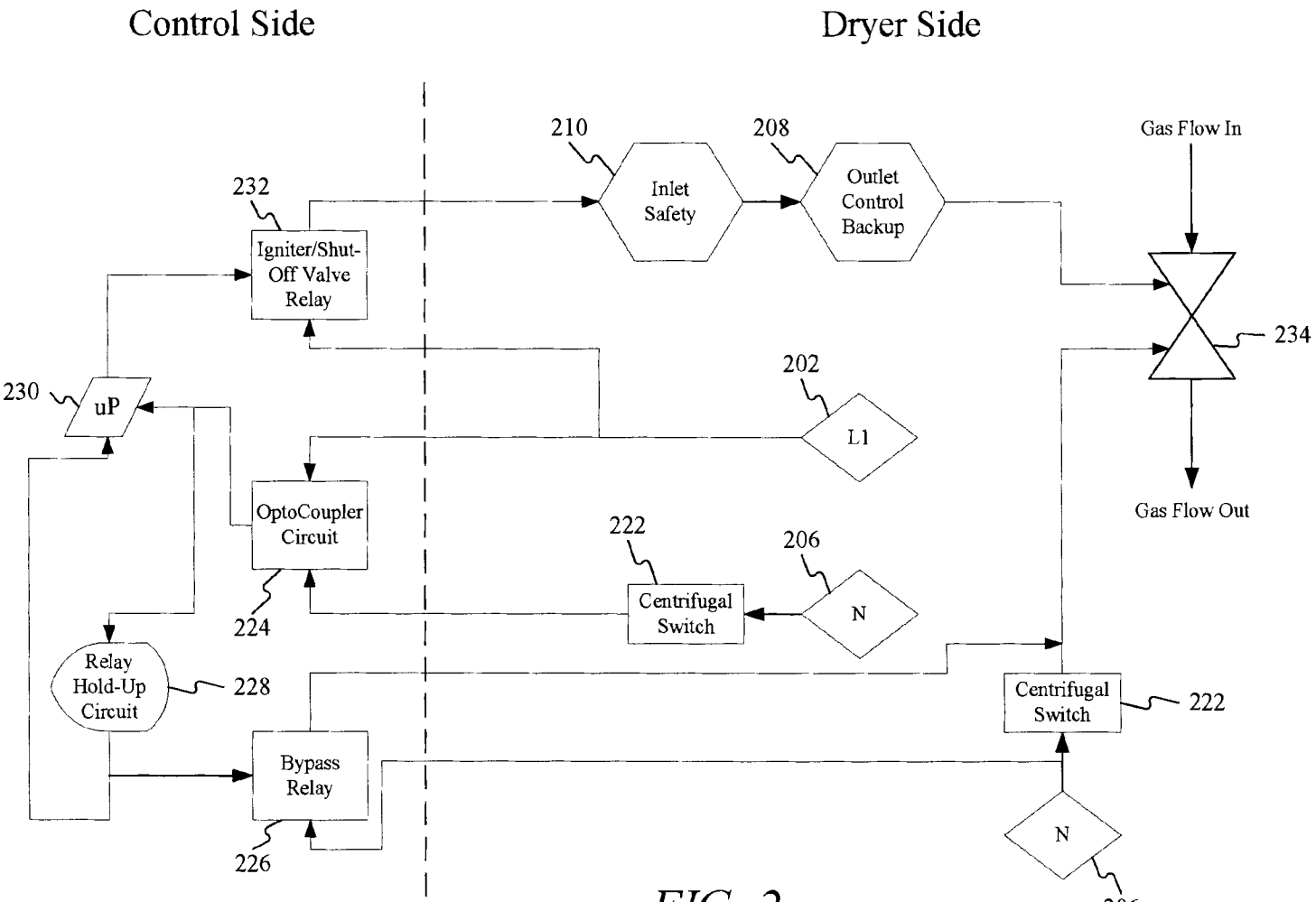
FIG. 2 depicts a control diagram for a gas dryer consistent with embodiments of the invention.

FIG. 2 depicts a control diagram for a gas dryer depicting a control side and a dryer side consistent with embodiments of the invention. Typically a gas dryer operates at 120 VAC with one hot wire (120 VAC) as indicated by reference numerals 202 and one neutral wire, as indicated by reference numeral 206, powering the dryer. Upon entering the dryer electricity flows through an igniter/shutoff valve relay 232. Once igniter/shutoff valve relay 232 is powered, power flows through an outlet safety backup 208 and an inlet safety 210. As described above, outlet safety backup 208 and inlet safety 210 are thermostats used to cut power to the dryer should temperatures within the dryer exceed predetermined limits. After the electricity travels through outlet safety backup 208 and inlet safety 210, it travels to an igniter/shutoff valve module 234. Note that igniter/shutoff valve module 234 may be a two-stage gas valve.

In order to complete the circuit and allow igniter/shutoff valve module 234 to activate, electricity from neutral wire 206 must travel through a centrifugal switch 222. Centrifugal switch 222 may be a single pole double throw switch. In other aspects of the invention centrifugal switch 122 may be a single pole single throw switch. When the drum is not rotating centrifugal switch 222 is open and igniter/shutoff valve module 234 does not activate because the circuit is broken. Once the drum is rotating, centrifugal switch 222 is "thrown" thereby completing the circuit and allowing the dryer to operate as normal.

Hot wire 202 also provides power to an optocoupler 224. Because optocoupler 224 is also connected to a centrifugal switch 222, optocoupler 224 does not receive power until the drum rotates and centrifugal switch 222 is thrown. During operation of the dryer optocoupler 224, a bypass relay 226, microcontroller 130, and a relay hold up circuit 228 operate to keep igniter/shutoff valve module 234 activated while the drum reverses its rotational direction.

To reverse the rotational direction of the drum, a controller may shut down the dryer motor. Once the drum has stopped, the polarity on the motor is reversed to cause the motor (i.e. the drum) to reverse rotation direction. During drum rotation, optocoupler 224 is used to power relay hold up circuit 228 keeping capacitor 314 discharged. Before the drum begins to slow down in order to change rotational direction, bypass relay 226 bypasses centrifugal switch 222 thereby keeping igniter/shutoff valve module 234 activated while the drum reverses its rotational direction. The interactions of optocoupler 224, bypass relay 226, and relay hold up circuit 228 will be discussed further below with respect to FIG. 3.

Figure 3:
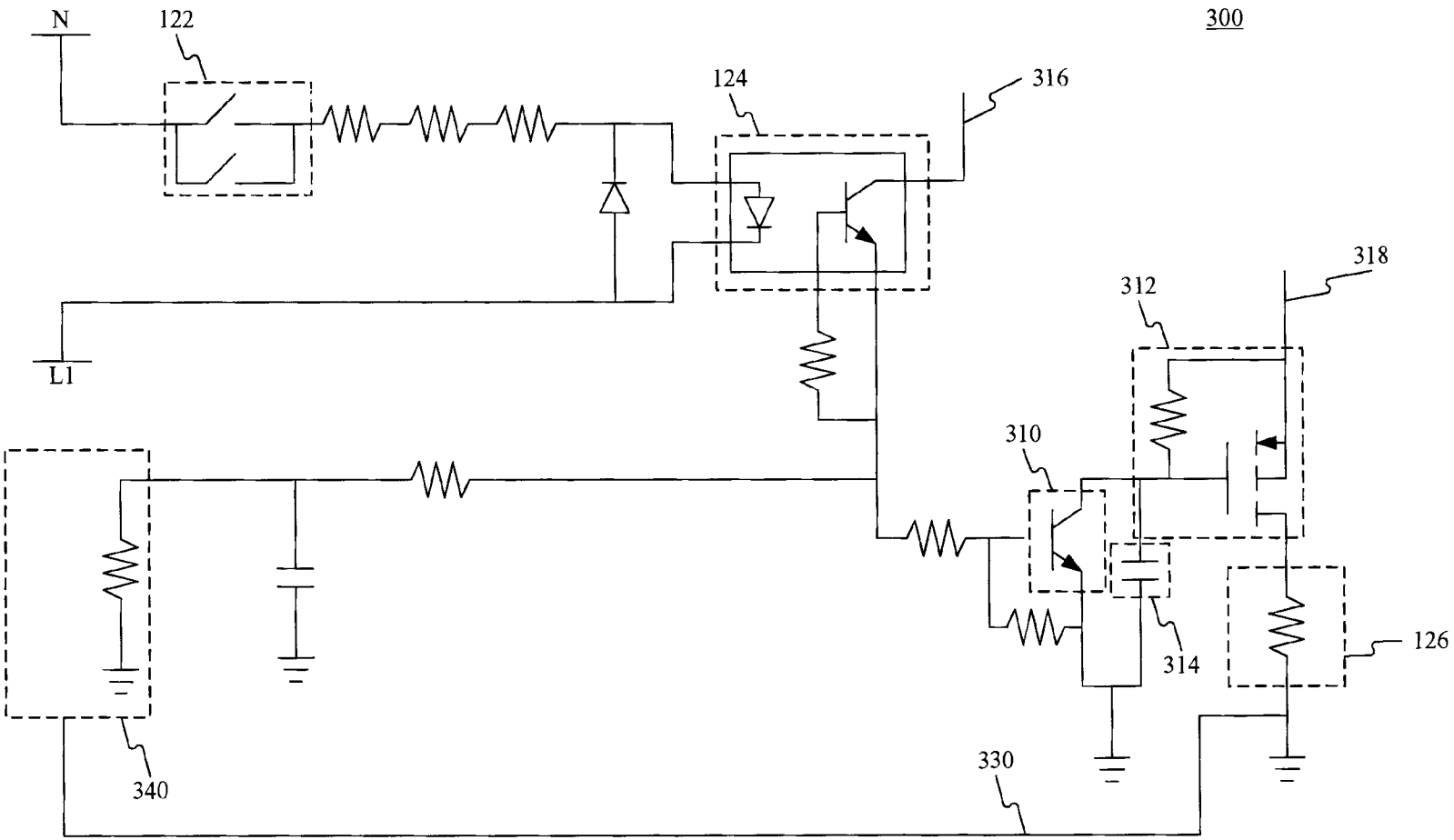
FIG. 3 depicts a wire diagram for a centrifugal switch bypass circuit consistent with embodiments of the invention.

Referring now to FIG. 3, FIG. 3 will be described with respect to an electric dryer as described in FIG. 1. FIG. 3 depicts a wire diagram for a centrifugal switch bypass circuit 300 consistent with embodiments of the invention. Centrifugal switch bypass circuit 300 provides a time period in which bypass relay 126 may bypass centrifugal switch 122 to allow the drum to reverse its rotational direction. For discussion purposes, the time period with which FIG. 3 will be described is six seconds. However, it should be understood that the time period may be longer or shorter than six seconds. In addition, the time period need not be fixed. As will be discussed below, the time period may be controlled by a controller 340.

Centrifugal switch bypass circuit 300 receives 120 VAC from hot wire 104. During drum rotation, centrifugal switch 122 closes and electricity flows through resistors. While three resistors are shown in FIG. 3, in other aspects of the invention a single resistor or multiple resistors of various resistance may be used to achieve a desired resistance. A diode controls the current flow.

After flowing through the resistors, current flows to optocoupler 124 which isolates the 120 VAC circuit from the DC low voltage circuits. When centrifugal switch 122 is closed, optocoupler 124 allows a signal 316 (e.g. 5 VDC), which acts as feed back to controller 340, to indicate that centrifugal switch 122 is closed. In addition, when centrifugal switch 122 is closed, optocoupler 124 allows signal 316 to reach a NPN transistor 310. Signal 316 activates NPN transistor 310 which allows bypass relay 126 to be activated, thereby bypassing centrifugal switch 122. When the NPN transistor is on, capacitor 314 is discharged, thereby allowing a field effect transistor (MOSFET) to be in the "on" state and power one side of the by-pass relay.

When centrifugal switch 122 is open, signal 316 is not allowed to activate NPN transistor 310. When NPN transistor 310 is not active a capacitor 314 begins to charge with a signal 318 (e.g. 12 VDC). Once the charge on capacitor 314 reaches a predetermined level, MOSFET 312 is deactivated by signal 318. In general, once capacitor 314 is charged it deactivates MOSFET 312 which in turn disables bypass relay 126 so that controller 340 cannot control bypass relay 126.

When centrifugal switch 122 is closed, controller 340 has the ability to control bypass relay 126 via a backside connection to bypass relay 126 as indicated by reference numeral 330. For instance, when the drum is about to reverse its rotational direction, controller 340 closes bypass relay 126 so that inner heating coil 116 and outer heating coil 120 may continue to receive power while the drum reverses and centrifugal switch 122 is open. When centrifugal switch 122 opens capacitor 314 begins charging and once it charges, it deactivates MOSFET 312. If the drum has not begun to rotate by the time MOSFET 312 is deactivated, centrifugal switch 122 is open and bypass relay 126 opens thereby cutting power to inner heating coil 116 and outer heating coil 120.

In the current example capacitor 314 is a 100 μF capacitor and time delay generated by the RC circuit is six seconds. The time delay may be adjusted by replacing the resistor in the RC circuit with a rheostat and having controller 340 adjusting the rheostat resistance.

Figure 4:
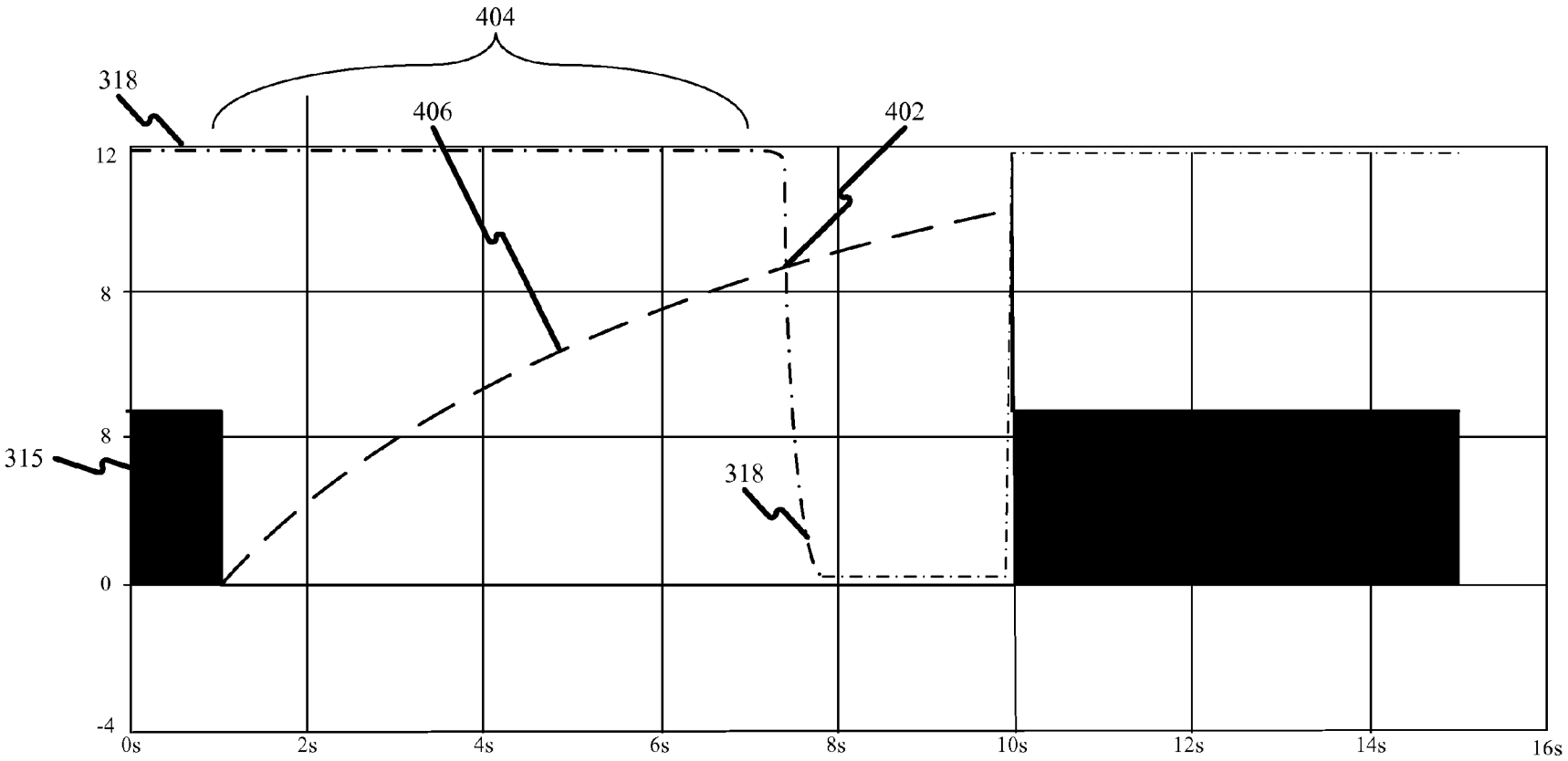
FIG. 4 depicts a simulation for the wiring diagram of FIG. 3 consistent with embodiments of the invention.

Turning now to FIG. 4, FIG. 4 depicts a simulation for the wiring diagram of FIG. 3 consistent with embodiments of the invention. From 0-1 second centrifugal switch 122 is closed and signal 316 is being allowed to reach NPN transistor 310. At 1 second, centrifugal switch 122 opens and capacitor 314 begins charging as indicated by reference numeral 406. After approximately 6 seconds capacitor 314 reaches a predetermined voltage and MOSFET 312 deactivates. When MOSFET 312 deactivates, signal 318 stops and bypass relay 126 opens. At approximately 10 seconds, centrifugal switch 122 closes and capacitor 314 discharges as indicated by reference numeral 406. Once capacitor 314 drops below a predetermined voltage and MOSFET 312 activates. When MOSFET 312 activates, signal 318 supplies voltage to one side of the bypass relay 126. The bypass relay 126 is allowed to be activated via the micropede 340.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A centrifugal switch bypass circuit for a dryer configured for bi-directional tumbling action, the dryer comprising a drying compartment, a motor, a centrifugal switch, and a heating element, the centrifugal switch bypass circuit comprising:

a bypass device operatively connected to the heating element and configured to:

bypass the centrifugal switch for a defined period of time upon receiving a signal from a controller prior to the controller causing a direction of the drying compartment to reverse rotational direction, wherein bypassing the centrifugal switch prevents the centrifugal switch from causing a deactivation of the heating element upon reversal of the rotational direction of the drying compartment, and deactivate, upon expiration of the defined period of time, the bypass device, wherein deactivating the bypass device comprises powering the centrifugal switch so long as a rotational speed associated with the drying compartment is maintained above a threshold speed; and a device hold circuit operatively connected to the bypass device, wherein during the period of time the centrifugal switch is being bypassed, the device hold circuit maintains activation of the heating element.

2. The centrifugal switch bypass circuit of claim 1, wherein the device hold circuit is further configured to cause the bypass device to stop bypassing the centrifugal switch after the period of time.

3. The centrifugal switch bypass circuit of claim 1, wherein the device hold circuit includes a resistor and a capacitor, and the period of time is determined by an RC time constant of the resistor and the capacitor.

4. The centrifugal switch bypass circuit of claim 3, wherein the resistor is a rheostat and the controller is configured to adjust the period of time by adjusting the resistance of the rheostat.

5. The centrifugal switch bypass circuit of claim 1, wherein the bypass device is configured to receive a signal from the centrifugal switch indicating that the drying compartment is rotating.

6. The centrifugal switch bypass circuit of claim 1, further comprising a centrifugal switch monitoring circuit configured to:

monitor whether the centrifugal switch is one of the following: open and closed, and send a signal to the device hold circuit indicating whether the centrifugal switch is one of the following: open and closed, wherein causing the bypass device to stop bypassing the centrifugal switch after the period of time comprises the device hold circuit being configured to bypass the centrifugal switch that the centrifugal switch is open.

7. The centrifugal switch bypass circuit of claim 1, wherein the drying compartment is a drum.

8. The centrifugal switch bypass circuit of claim 1, wherein during drying compartment rotation the centrifugal switch is in the closed position, the centrifugal switch bypass circuit further comprising:

a centrifugal switch monitoring circuit configured to:

indicate when the centrifugal switch is in the closed position, and output a first signal when the centrifugal switch is in the closed position;

an optocoupler configured to output a second signal when the centrifugal switch is in the closed position; and a controller configured to:

receive the second signal, and cause the bypass device to bypass the centrifugal switch when the centrifugal switch is in the closed position.

9. The centrifugal switch bypass circuit of claim 1, where the bypass device is a bypass relay including a bypass relay coil having a first side and a second side, the centrifugal switch bypass circuit further comprising:

an optocoupler configured to output a first signal;

a NPN transistor configured to be activated by the first signal;

a field effect transistor configured to output a second signal to the first side of the bypass relay coil; and a controller configured to:

determine when the bypass relay coil should be closed, and provide a ground signal to the second side of the bypass relay coil to close the bypass relay coil when the controller determines that the bypass relay coil should be closed.

10. A method for bypassing a centrifugal switch of a bi-directional tumbling action dryer, the method comprising:

receiving an indication that a drying compartment of the dryer is beginning to reverse rotational direction;

utilizing a switching device to bypass the centrifugal switch for a defined period of time upon receiving a signal from a controller, wherein the centrifugal switch is configured cause a deactivation of a heating element of the dryer upon reversal of the rotational direction of the drying compartment and wherein the switching device causes a bypass of the centrifugal device in order to prevent the deactivation of the heating element, and deactivating, upon expiration of the defined period of time, the switching device, wherein deactivating the switching device comprises powering the centrifugal switch so long as rotational speed associated with the drying compartment is maintained above a threshold speed; and utilizing a hold circuit to cause the switching device to continue bypassing the centrifugal switch during reversal of the rotational direction and wherein during the period of time the centrifugal switch is being bypassed, the hold circuit maintains activation of the heating element.

11. The method of claim 10, further comprising utilizing the hold circuit to cause the switching device to stop bypassing the centrifugal switch after the period of time.

12. The method of claim 11, where the period of time is determined by an RC time constant and the RC circuit is comprised of a capacitor and a rheostat, the method comprising adjusting the period of time by adjusting the resistance of the rheostat.

13. The method of claim 10, further comprising:

receiving, at the hold circuit, a signal indicating that the centrifugal switch is open;

wherein utilizing the hold circuit to cause the switching device to continue bypassing the centrifugal switch during the reversal of the rotational direction comprises causing the switching device to stop bypassing the centrifugal switch after the period of time when the centrifugal switch is open.

14. The method of claim 10, wherein when the drying compartment is not rotating the centrifugal switch is in the open position, the method further comprising:

utilizing a centrifugal switch monitoring circuit to indicate when the centrifugal switch is in the open position; and receiving, at an optocoupler from the centrifugal switch monitoring circuit, a signal when the centrifugal switch is in the open position, causing the switching device to bypass the centrifugal switch for the period of time when the centrifugal switch is in the open position.

15. The method of claim 10, where the switching device comprises a bypass relay including a bypass relay coil having a first side and a second side, the method further comprising:

outputting a first signal from an optocoupler;

activating, by the first signal, a NPN transistor;

outputting a second signal to the first side of the bypass relay coil from a field effect transistor;

determining when the bypass relay coil should be closed; and receiving at the second side of the bypass relay coil providing a ground signal to, the ground signal closing the bypass relay coil when the controller determines that the bypass relay coil should be closed.

16. The centrifugal switch bypass circuit of claim 1, wherein the centrifugal switch is configured to cause the deactivation of a heating element of the dryer when the drying compartment's rotational speed below the threshold speed.

17. The method of claim 10, wherein the switching device is configured to cause the deactivation of a heating element of the dryer when the drying compartment's rotational speed below the threshold speed.

* * * * *